United States Patent [19]

Nishikawa

[11] 4,273,438

[45] Jun. 16, 1981

[54] ELECTROSTATOGRAPHIC PRINTING METHOD AND APPARATUS

[75] Inventor: Masaji Nishikawa, Hachioji, Japan

[73] Assignee: Olympus Optical Co., Ltd., Tokyo, Japan

[21] Appl. No.: 962,798

[22] Filed: Nov. 21, 1978

[30] Foreign Application Priority Data

Nov. 24, 1977 [JP] Japan ..... 52-139816

[51] Int. Cl.[3] ..... G03G 15/00

[52] U.S. Cl. ..... 355/14 CU; 101/DIG. 13; 355/3 R

[58] Field of Search ..... 355/3 R, 3 FU, 16, 14; 96/1.4; 101/DIG. 13; 430/31

[56] References Cited

U.S. PATENT DOCUMENTS

| | | | |
|---|---|---|---|
| 3,508,823 | 4/1970 | Gundlach et al. | 355/3 R |
| 3,526,191 | 9/1970 | Silverberg et al. | 355/3 R X |
| 3,600,086 | 8/1971 | Cates et al. | 355/16 |
| 3,615,128 | 10/1971 | Bhagat | 355/3 R |
| 3,655,280 | 4/1972 | Zoppoth | 355/3 FU |
| 3,795,442 | 3/1974 | Kimura et al. | 355/3 R |

*Primary Examiner*—Richard L. Moses
*Attorney, Agent, or Firm*—Haseltine and Lake

[57] ABSTRACT

A method for printing a great number of duplicated copies of an original with the aid of the same and single master comprises (1) a step for forming on a photoconductive member such as a zinc oxide paper a primary electostatic charge latent image corresponding to an image of the original by subjecting the member to a uniform charging and an imagewise exposure;

(2) a step for developing the primary latent image with dry toner particles such as a two component developer having high resistance to form a primary toner image;

(3) a step for fixing the primary toner image by flash light having visible light removed therefrom or solvent gas in such a manner that the photoconductive property of the member can be retained to form the master;

(4) a step for subjecting the master to a uniform charging and a uniform exposure in succession to form a secondary electrostatic charge latent image on the master;

(5) a step for developing the secondary latent image with toner particles to form a secondary toner image on the master;

(6) a step for transferring the secondary toner image onto an image receiving member such as a plain paper; and (7) a step for fixing the secondary toner image transferred onto the image receiving member to form a final copy; whereby a number of copies are formed by repeating the above steps (4) to (7) in succession.

4 Claims, 15 Drawing Figures

ELECTROSTATOGRAPHIC PRINTING METHOD AND APPARATUS

BACKGROUND OF THE INVENTION

The present invention relates to an electrostatographic printing method for forming a plurality of duplicated copies of an original comprising a step for forming a primary electrostatic charge latent image corresponding to an image of the original on a photosensitive member including photoconductive material; a step for developing the latent image with a toner development agent to form a primary toner image; a step for fixing the primary toner image to form a printing master; and a step for forming a plurality of copies with the aid of the printing master in an electrophotographic manner.

The present invention also relates to an apparatus for forming such a printing master and an apparatus for printing a plurality of copies with the aid of the printing master.

Heretofore there have been proposed various methods for printing a number of duplicated copies by an electrophotographic process or printing process on the basis of the same and signal master image once formed by a single exposure step. For instance in U.S. Pat. No. 2,951,443, No. 3,363,555, No. 3,598,580 and No. 3,627,523 there is disclosed a method for forming a plurality of duplicated copies by a single electrostatic charge latent image once formed on a photoconductive member is repeatedly developed with toner particles and each toner image is transferred onto a paper without deteriorating the latent image. In a Japanese Patent Publication No. 20,347/65 there is described another printing method wherein a photosensitive member on which a toner developed image has been formed is subjected to strong light to form a master image composed of persistent conductivity pattern, and a plurality of copies are formed by subjecting repeatedly the master image to well known electrophotographic processes. Further in a Japanese Patent Publication No. 42,469/71 there is disclosed a printing method in which a high resistive resin layer is selectively formed on a toner image which has been formed on a photosensitive member and after that the photosensitive layer is exposed to strong light to form a master image composed of persistent conductivity pattern corresponding to the toner image. In another method described in a Japanese Patent Laid-Open Publication No. 34,836/74 a toner image which has been formed by an electrophotographic process is transferred onto a conductive sheet to form a master image. In a Japanese Patent Publication No. 23,288/73 there is disclosed still another method wherein a photosensitive member having a toner image formed thereon is subjected to a heating process so as to break thermally a non-pictorial area of the member to form a printing master. In Japanese Patent Laid-Open Publication No. 8,730/72 (corresponding to U.S. Patent Application Ser. No. 81,212 filed on Oct. 16, 1970) there is described another method in which an electrostatic latent image formed on a photosensitive member is developed with toner particles, the toner image thus formed is transferred onto a web while a part of the toner image being remained on the photosensitive member, the electrostatic latent image is enhanced by effecting uniform charging and exposing steps, the enhanced latent image is developed with toners, the toner image thus formed is partially transferred to an image receiving member and the above steps are successively repeated to form a number of duplicated copies. Further in the Japanese Laid-Open Publication No. 39,044/76 there is described a method wherein a toner image is formed on a transparent photosensitive member to form a printing master. In a Japanese Patent Publication No. 21,095/65 still another known method is disclosed in which use is made of a master which has been formed by an electrically insulating toner image on a photosensitive member, an electrostatic charge latent image is formed on the toner image by effecting uniform charging and exposing steps, the latent image thus formed is developed by a liquid development step and only the toner image formed by the liquid development is transferred onto a record paper.

In the known methods in which a master image is composed of persistent conductivity pattern the persistent conductivity is liable to be deteriorated depending on the number of copies and thus the maximum number of copies is limited. Since in another known methods special photosensitive material, toners and surface coatings have to be used the processes are complicated and thus become expensive. Under the circumstances in a practically used multi-copying method a toner image is formed on a zinc oxide paper by liquid or dry toner development and is then fixed thereon, a non-pictorial area is made insensitive to oily paint or a pictorial area is made sensitive to oily paint to form a master image and a number of copies are formed by off-set printing with the aid of the master. However in this known method oily paint having high viscosity might stain the apparatus and the operation is liable to be critical as compared with general copying machines. Moreover if the printing apparatus is made automized, the whole apparatus becomes quite large in size.

SUMMARY OF THE INVENTION

The present invention has for its object to provide a novel and useful method by means of which a number of duplicated copies of high quality can be formed with the aid of a single imagewise exposure.

It is another object of the invention to provide an electrographic printing method in which any special material is not needed to form the copies and thus which can be carried out economically.

According to the invention a method for forming a plurality of copies of an original with the aid of a single imagewise exposure comprises (1) a step for forming on a photoconductive member a primary electrostatic charge latent image corresponding to an image of the original;

(2) a step for developing said latent image with toner particles into a visible primary toner image;

(3) a step for fixing the toner image to form a master, while the photoconductive property of the photoconductive member is retained;

(4) a step for electrifying uniformly the master;

(5) a step for exposing uniformly the master to form thereon a secondary electrostatic charge latent image corresponding to the fixed toner image on the master;

(6) a step for developing the secondary latent image with toner particles to form a secondary toner image on the fixed toner image of the master;

(7) a step for transferring the secondary toner image onto an image receiving member; whereby the last four steps (4) to (7) are repeatedly carried out in succession to form a plurality of duplicated copies.

According to a preferred embodiment of the method according to the invention the primary toner image is formed by developing the primary latent image with a two component dry toner developer composing of electrically insulating toner particles and iron particles.

In the method according to the invention the primary toner image can be advantageously fixed by a flash light fixing or a solvent gas fixing. In a preferred embodiment the toner image is fixed by the flash light having the visible light component filtered out.

A printing apparatus according to the invention comprises means for forming on a photoconductive member a primary electrostatic charge latent image corresponding to an image to be duplicated;

means for developing the primary latent image with a dry toner developer agent to form a primary toner image; and means for fixing the primary toner image on the photosensitive member to form a master in such a manner that the photoconductive property of the member is effectively retained without deterioration; whereby a plurality of duplicated copies are formed by repeatedly effecting for the master thus formed a uniform electrification, a uniform exposure, developing and transferring steps in succession.

In a preferred embodiment of the printing apparatus according to the invention means for forming a number of copies with the aid of the master are also provided in the apparatus for making the master.

DESCRIPTION OF THE PREFERRED EMBODIMENTS

Figure 1A:
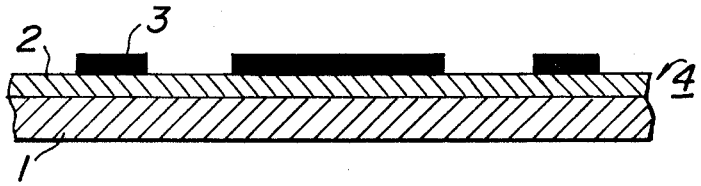
FIGS. 1(*a*) to 1(*e*) show schematically successive steps of a printing method according to the invention.
Figure 1B:
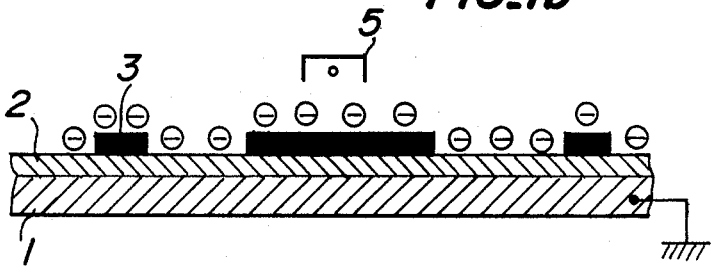
Figure 1C:
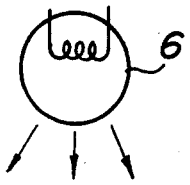
Figure 1C:
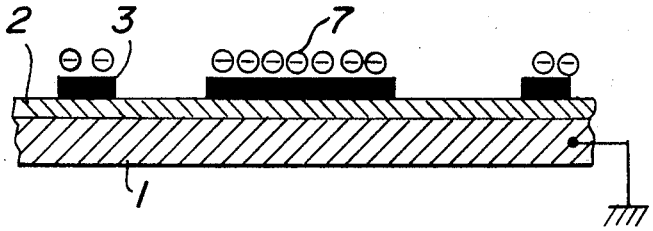
Figure 1D:
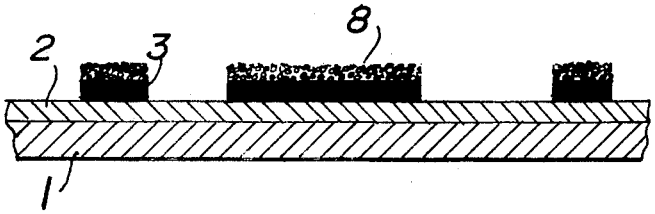
Figure 1E:
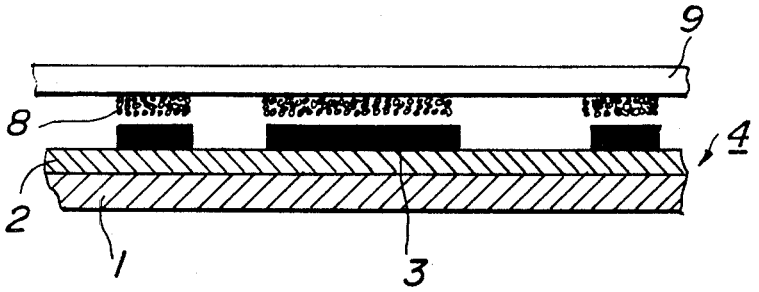

FIGS. 1(*a*) to 1(*e*) show schematically successive steps of the printing method according to the invention. At first on a photosensitive member comprising an electrically conductive substrate 1 and a photoconductive layer 2 applied on the substrate is formed a primary toner image 3 by means of an ordinary electrophotographic process with the aid of a single imagewise exposure. The toner image 3 is fixed in such a manner that a photoconductive property of the photoconductive layer 2 is not deteriorated or lost. The assembly 1, 2 and 3 shown in FIG. 1(*a*) serves as a master 4 for succeeding electrostatographic printing.

Then as illustrated in FIG. 1(*b*) the master 4 is uniformly charged in a given polarity, in this example the negative polarity, by means of a corona charger 5.

Next the master 4 is uniformly exposed by a lamp 6 as shown in FIG. 1(*c*). During this uniform exposure the negative charge on the photoconductive layer 2 is conducted away through the photoconductive layer 2 and the substrate 1, whereas the negative charge on the toner image 3 is retained thereon, because the toner image 3 is formed by electrically insulating toner material. As a result a secondary electrostatic charge latent image 7 corresponding to the primary toner image 3 is formed on the master 4.

Next as depicted in FIG. 1(*d*) the secondary latent image 7 is developed with toner particles having charged in positive polarity so as to form a secondary toner image 8 on the master 4.

As shown in FIG. 1(*e*) the secondary toner image 8 is transferred onto an image receiving member 9 such as a plain paper and the transferred toner image 8 is fixed by means of any suitable fixing process such as heating to form a final duplicated copy.

By repeating the steps shown in FIGS. 1(*b*) to 1(*e*) in succession for the same master 4 any number of duplicated copies can be obtained.

In the method according to the invention use is made of the fixed toner image as the printing master and thus a great number of copies having excellent image quality can be formed stably and rapidly. For this purpose the primary toner image should have sufficient electrically insulating property and the photoconductive layer should have good conductivity when it is irradiated by radiation.

Next toner material and photoconductive material suitable for the method according to the invention will be explained in greater detail.

Figure 2:
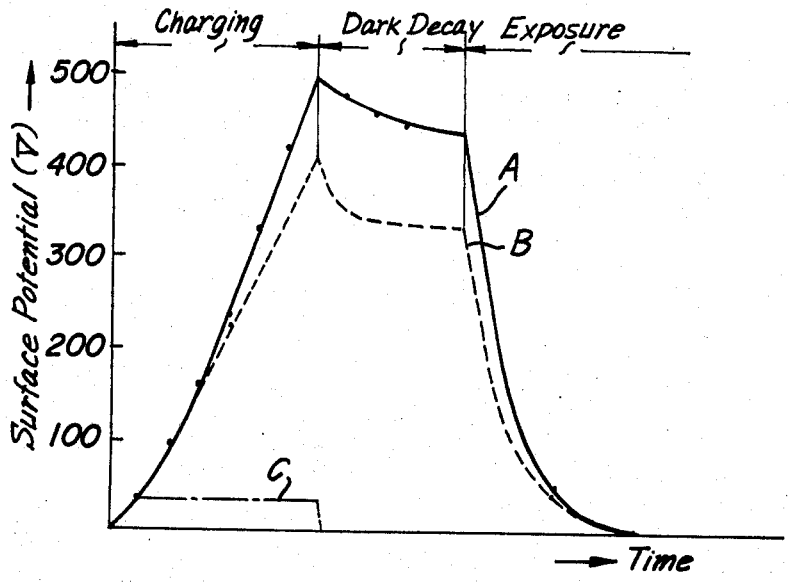
FIG. 2 illustrates electrification property of a zinc oxide paper having a toner image formed with liquid developer.

At first use was made of a photosensitive zinc oxide paper which is commonly used as a master of off-set printing. A primary electrostatic charge latent image formed on this paper was developed with liquid developer and then the paper was naturally dried to form a master having a primary toner image. Then the electrification or charging property of the master thus formed was measured. The measuring result is shown in FIG. 2. In a graph of FIG. 2 an abscissa denotes a time and an ordinate a surface potential V. A curve A represents a charging characteristic of the zinc oxide paper itself. A curve B illustrates a charging property of a non-pictorial area of the developed zinc oxide paper, i.e. an area on which the toner particles are not deposited. A curve C expresses a charging property of a pictorial area of the master, i.e. an area on which the toner particles are deposited at a density D=1.2. At first the paper was charged in dark, then retained in dark and finally was exposed by uniform light. The original zinc oxide paper which has not been developed in liquid can be charged to a high potential and has a very low dark decay. When it is irradiated by light, the discharge is effected rapidly and the charge potential decreases to a sufficiently low level upon exposure. As can be read by comparing the curves A and B the non-pictorial area of the developed zinc oxide paper can retain charge thereon to a substantially same extent as the non-developed zinc oxide paper. That is the charge potential on the non-pictorial part is slightly lower than that of the non-developed paper. Whilst the pictorial area of the developed zinc oxide paper can retain only a very small amount of charge as illustrated in the curve C. In other words the toner particles have good conductivity. Therefore the developed zinc oxide could not be used as the master sheet for use in the method according to the invention. However upon considering the above mentioned property, i.e. the toner image being hardly electrified it may be used as a negative master by charging it in dark. In this case the electrostatic charge is retained on the non-pictorial area to form a secondary latent image of negative or reversed nature.

Figure 3:
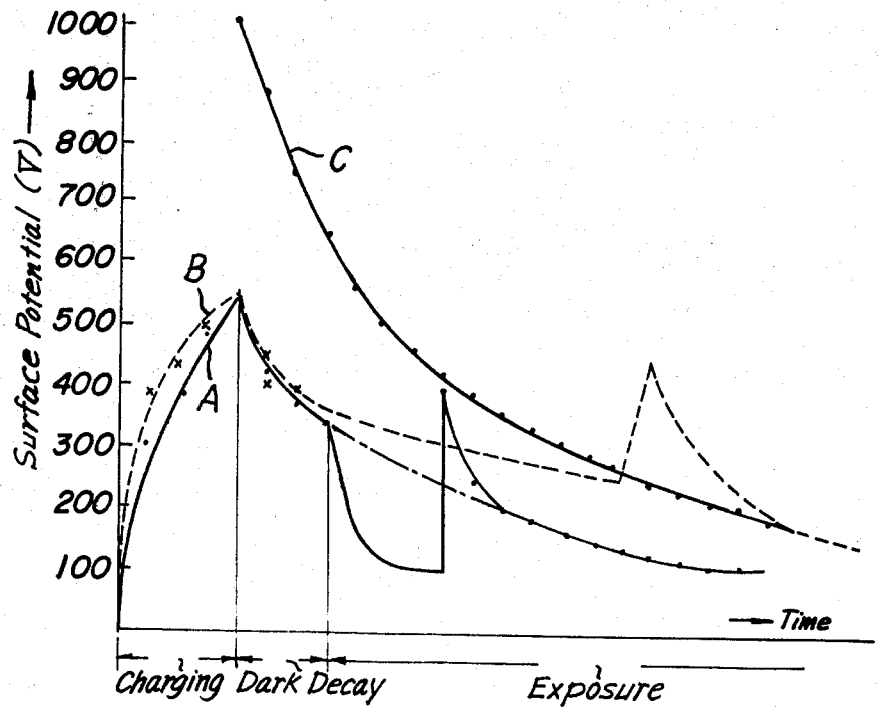
FIG. 3 shows charging characteristics of a zinc oxide paper having a toner image developed with a dry toner developer and fixed by heating.

FIG. 3 shows curves A, B and C of a zinc oxide paper having a toner image which was developed with two component dry toner developer composed of toner particles and iron powders and fixed by an oven type heater. The curve A represents the charging characteristic of the non-pictorial area of the developed zinc oxide paper. This area can be charged rapidly as compared with the original zinc oxide paper shown by the curve A in FIG. 2, but exhibits a relatively large dark decay. Upon exposure the surface potential once decreases and after that increases suddenly and then decreases again. The last mentioned decay is not so abrupt and reaches the dark decay characteristic curve shown by a chain line. Judging from such a characteristic it can be understood that the zinc oxide paper developed with dry developer could not be used as the master. The curve B illustrates the charging characteristic of the pictorial area, i.e. the toner image. This characteristic is substantially same as that of the non-pictorial area. But the charge potential on the pictorial area does hardly respond to the light exposure and the residual charge potential is higher than that on the non-pictorial area. From such a result it can be said that the pictorial and non-pictorial areas have been influenced by heating to a substantially same extent. The curve C is the charging characteristic of the non-pictorial area of the developed zinc oxide paper which has been heated once again. This non-pictorial area is easily charged up to 1,000 V, but the dark decay is quite large and further the sensitivity to light could not be observed. Therefore the zinc oxide paper having the toner image fixed thereto by heating could not be used as the master for use in the method according to the invention.

Various photosensitive members other than zinc oxide paper were examined by fixing the toner image by heating. When a photosensitive member made of selenium was heated to a fixing temperature, the crystallization was enhanced to deteriorate the photosensitive property and charging characteristic. In case of organic photosensitive members decomposition and charge into a molecular state occurred when they were heated to the fixing temperature, so that the photosensitive and charging characteristics were changed to an inadmissible extent. Therefore it was difficult to obtain the master by means of such procedures.

Next experiments were conducted by fixing the toner image with using a flash light fixing method and a solvent gas fixing method.

Figure 4:
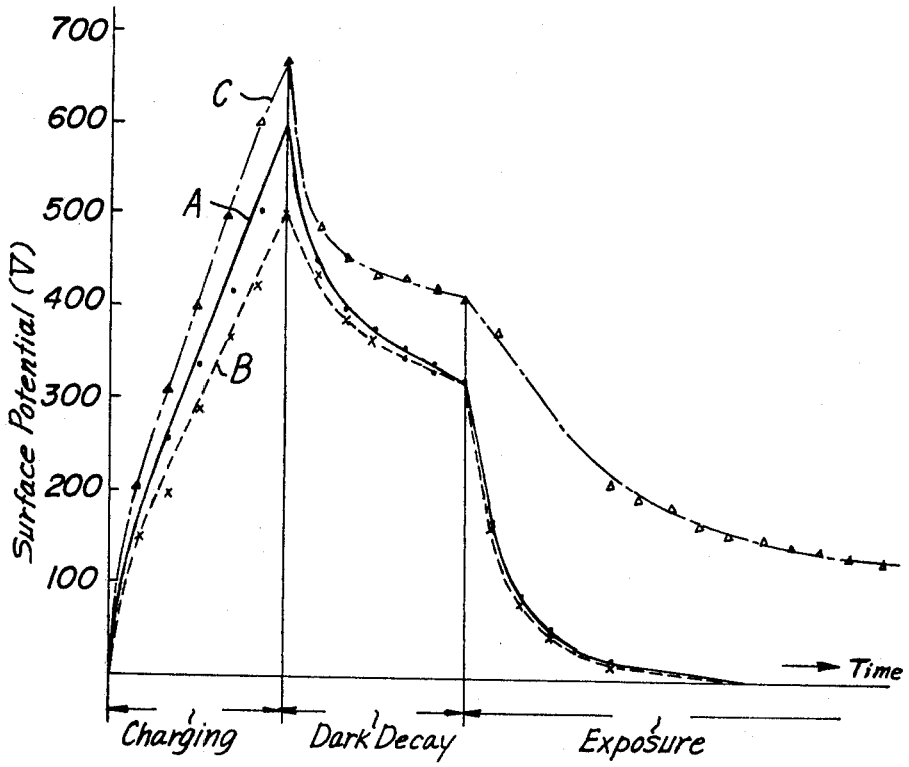
FIG. 4 depicts charging characteristics of a zinc oxide paper having a toner image developed with a dry toner developer and fixed by a flash light or a solvent gas.

FIG. 4 shows charging characteristic curves of the master which was formed by the flash light fixing. A curve A represents a charging property of a non-pictorial area of a zinc oxide paper which has a toner image developed with two component dry developer and fixed by flash light. A curve B is a charging characteristic of a non-pictorial part of a zinc oxide paper which has a toner image fixed by gas solvent. As compared with the original zinc oxide paper shown by the curve A in FIG. 2 the solvent gas fixed paper has a slightly large dark decay, but its charging property is substantially same as that of the original zinc oxide paper. A curve C in FIG. 4 represents the charging characteristic of the pictorial part of the flash light fixed paper. The pictorial part can be charged to a high potential value than the non-pictorial part. The dark decay of the pictorial portion is relatively small. Although the potential is decreased by exposure only to a limited extent, so that a relatively high potential is retained on the pictorial portion for a quite long time. A reason why such a high potential remains on the toner image is that the electrically insulating toner particles can effectively retain electrostatic charge thereon and light ray is prevented by the toner particles from impinging upon the zinc oxide paper. In this experiment a reflection density of the toner image was about 0.5, but in practice the maximum reflection density would be more than 1.0. Thus the above mentioned two phenomena will be enhance, so that a higher potential can be retained on the toner image.

As explained above with reference to FIG. 4 the toner image formed on the zinc oxide paper with dry two component developer and fixed by the flash irradiation or solvent gas can form the master which can be effectively used in the method according to the invention. By repeatedly subjecting the master thus formed to the uniform electrification and exposure in succession it is possible to form repeatedly the secondary electrostatic charge latent image on the zinc oxide master paper. For each secondary latent image is effected the development with toner particles to form a secondary toner image. This secondary toner image is transferred onto the paper and the transferred toner image is fixed by any suitable fixing process. The non-pictorial area of the master paper is repeatedly subjected to exposure and thus electrostatic charge on this area can be completely discharged. Whereas the potential on the pictorial area of the master paper can be maintained to a substantially constant value by repeating the uniform electrification and exposure. Therefore the number of duplicated copies obtained by the single master paper is only limited by mechanical damage of the master such as wear of the paper and the scraping of toner image from the paper. Therefore several thousand copies could be formed from the single master paper.

As compared with the fixing by the oven type heater in the flash light fixing the heating of the paper is instantaneously effected and thus the photoconductive material of the paper is hardly influenced by the heating. Also in the solvent gas fixing the zinc oxide paper is not affected by the instantaneous contact with the solvent gas.

As explained above the toner image fixed by flash light and solvent gas can be used as the master for use in the method according to the invention. In this case cheap photoconductive members such as the zinc oxide paper, organic photosemiconductor sheet and the like are preferably used, because it is preferable to abandon the masters after the given number of copies have been printed. If an expensive photoconductive member such as a selenium drum is used, the drum could not be abandoned, and thus it is necessary to remove the fixed toner image from the selenium drum. For example the fixed toner image formed by the xerography method can be removed by solvent.

According to the invention as the toner developer for developing the primary latent image use may be preferably made of the two component and single component developing agents. By using such developing agents it is possible to clean the master each time after the transfer step has been completed so as to avoid fog due to residual toners. If the problem about cleaning of residual toners, decrease in resistance of pictorial area, deterioration of photoconductivity at non-pictorial area would be solved in a liquid development, the toner image on the master could be fixed by a liquid development. As the two component developer an ordinary developer comprising high resistive toner particles and iron powder carriers can be advantageously used together with a known magnetic brush developing device. Further a conventional cascade developing device may be used for the two component developing agent consisting of high resistive toner particles and glass bead carriers. Since the toners for forming the primary toner image on the master is not transferred onto the image receiving paper sufficiently fine toner particles can be used. The finer the toner is used, the better master image can be obtained. The single component toner consisting of powders of magnetic material has relatively low resistance and thus is not suitable for the method according to the invention. But if the resistance of the magnetic powders could be made high, such toners could be advantageously used.

The inventor has found that the excellent master can be formed by the flash light fixing and solvent gas fixing. It should be noted that the present invention is not limited to such fixing methods, but other method may be used as long as the photoconductive property of the photosensitive member is not affected by the fixing procedure and the electrostatic charge on the non-pictorial area of the master can be reduced to a sufficiently low level by the exposure. In this case the increase in the dark decay is not always harmful, but it is preferable to limit this increase in the dark decay.

Next a change in the property of the master depending on time will be explained.

Figure 5:
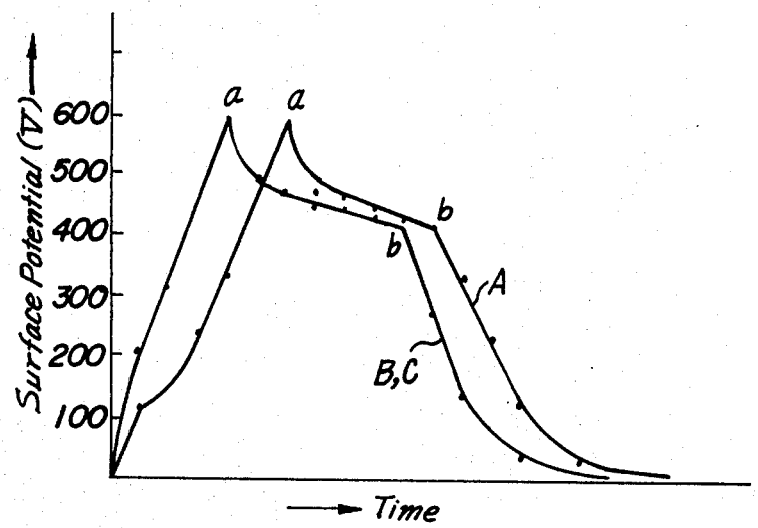
FIG. 5 shows charging characteristics of a zinc oxide paper which is left in a bright room without being subjected to any treatment.

FIG. 5 shows graphs representing the charging property of the original zinc oxide paper which has been left in a bright room. A curve A shows a case in which the paper was charged immediately after the paper was transported in a dark room. Curves B and C represents the charging characteristics which were measured 90 and 180 seconds, respectively after the transportation into the dark room. In the graphs an alphabet a represents an end timing of uniform charging and b a start timing of uniform exposure. As can be understood from these curves A to C there is no substantial difference among these characteristics other than an initial charging rate. Therefore it is possible to charge the original zinc oxide paper to a substantially constant potential as long as the charging time is made sufficiently long, even if the charging is started at any time after the paper is brought in the dark room. The constant charging potential may be realized by arranging a control grid in front of an opening of the corona charger. From the fact that the curves A and B are identical with each other it can be said that the charging property can be stabilized within 90 seconds from the transportation into the dark room.

Figure 6:
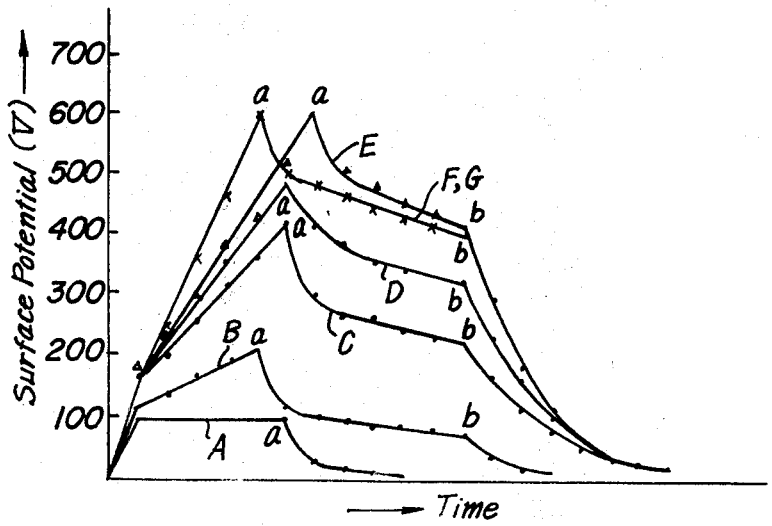
FIG. 6 illustrates charging characteristics of a zinc oxide paper having a toner image fixed by a flash light at various timings after the fixing.

FIG. 6 illustrates a charging property of the master of zinc oxide paper having the primary toner image fixed by flash light. The fixing was carried out in the bright room. A curve A represents a case in which the charging and exposure were conducted immediately after the fixing procedure. In this case the charging level is extremely low and the dark decay is very large. Curves B, C, D, E, F and G show charging characteristics after 90, 180, 270, 360, 450 and 540 seconds, respectively from the transportation into the bright room. From these curves it is clear that the charging potential level, charging rate and discharging rate due to the exposure increase and the dark decay decreases in dependence upon the time after the transportation into the dark room. After 360 seconds from the transposition the charging characteristic becomes stable. Thus the stable electrophotographic printing can be effected after about four minutes from the flash light fixing. In case that the master formation and duplication are carried out by separate devices there might occur no problem, because the master is made stable during the installation of the master in the printing device. However if the formation of the master and the duplication with the aid of master are carried out by the same apparatus, the above explained stabilization of the master might limit an operation speed of the apparatus.

In order to avoid the above mentioned drawback of the master stabilization the inventor has conducted experiments in which the flash light for fixing the primary toner image was passed through filters.

Figure 7:
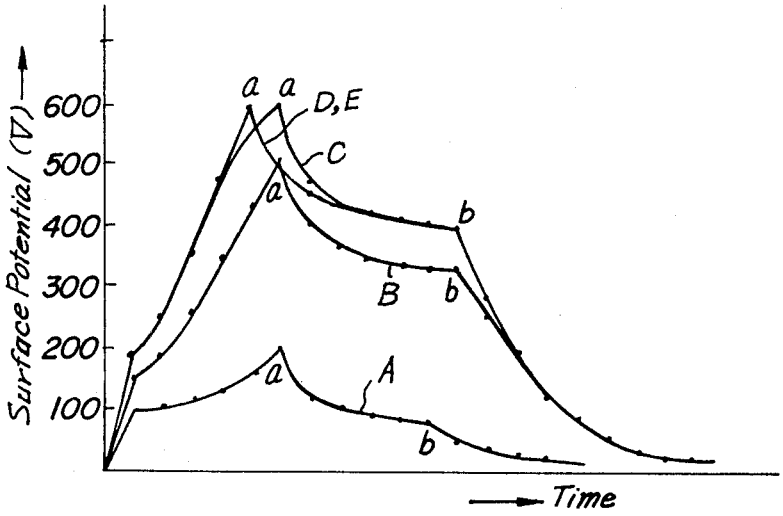
FIG. 7 shows charging characteristics of a zinc oxide paper having a toner image fixed by a flash light having wavelength longer than 480 mμ.

FIG. 7 shows charging characteristics of the master having the primary toner image fixed by flash light exposure with using a filter which cuts off light rays having wavelength shorter than 480 mμ. Curves A, B, C, D and E represent characteristics after 90, 180, 270 and 360 seconds, respectively from the fixing step. It can be understood that the charging property of the master becomes stable within 180 seconds after the fixing.

Figure 8:
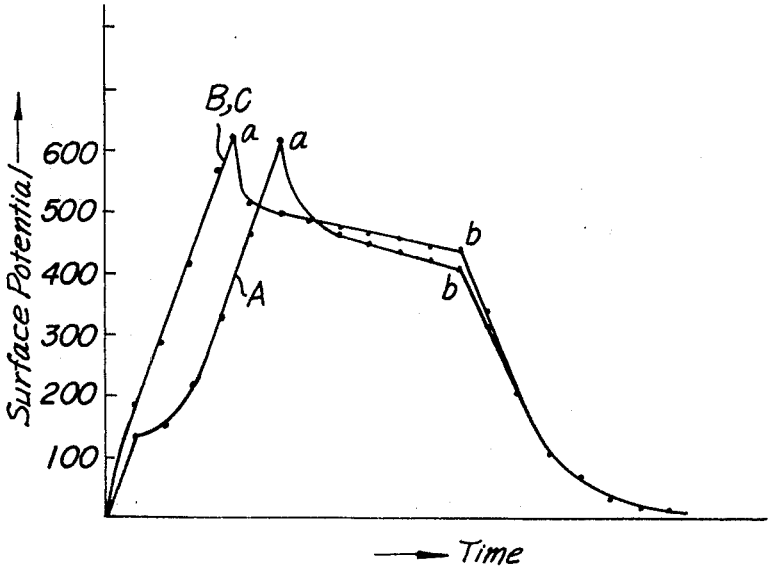
FIG. 8 illustrates charging characteristics of a zinc oxide paper having a toner image fixed by a flash light in which light components shorter than 620 mμ or 640 mμ have been removed.

FIG. 8 shows the results obtained by using two kinds of filters cutting off light rays having wavelengths shorter than 620 and 640 mμ, respectively. A curve A represents a charging characteristic after 90 seconds fromthe fixing and curves B and C express those after 180 seconds. As can be seen upon comparing these curves with those shown in FIG. 5 the master having the primary toner image fixed by flash light through the filters has almost same charging property as that of the original zinc oxide paper. In other words the zinc oxide paper is hardly affected by the flash light having longer wavelengths. Further it has been confirmed that the primary toner image could be effectively fixed under the exposure of such flash light having wavelengths longer than about 600 mμ. The fixing with flash light is effected by infrared radiation and thus there might occur no problem in using the filter for cutting off visible light. The use of infrared radiation can yield another advantage that the stray light out of a housing of the apparatus does not give unfavorable impression upon a user.

Now several embodiments of a printing apparatus for carrying out the above mentioned method according to the invention will be explained.

Figure 9:
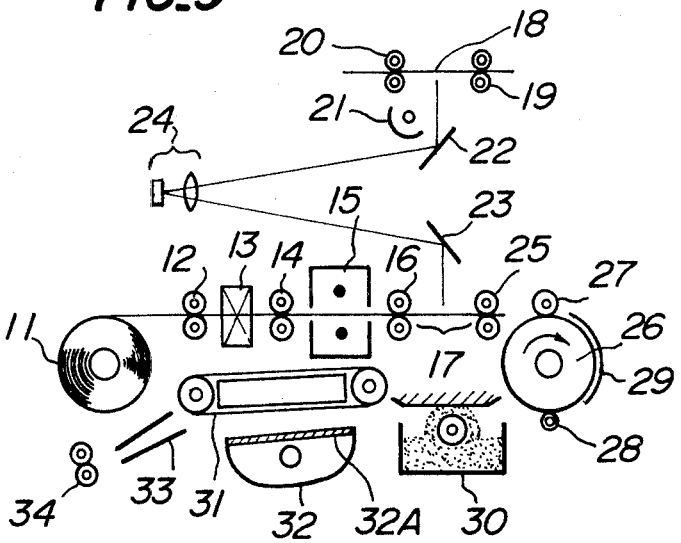
FIG. 9 is a schematic view showing an embodiment of an apparatus according to the invention for forming a master.

FIG. 9 shows schematically a first embodiment of the printing apparatus according to the invention. In the present embodiment use is made of a photosensitive zinc oxide paper roll 11 from which a given length of paper is fed by rollers 12 and cut by a cutter 13 to form a sheet of zinc oxide paper having a given length. The zinc oxide paper sheet is fed into a uniformly charging section comprising a corona charger 15 by means of feeding rollers 14. The uniformly charged sheet is further fed by rollers 16 into an exposure section 17. An original document 18 to be duplicated is illuminated by an illuminating device 21 while the document is fed at a constant speed by means of feeding rollers 19 and 20. Light reflected by the document is directed by means of reflection mirrors 22 and 23 and a projecting lens system 24 onto the photosensitive sheet at the exposure section 17. In this manner on the sheet is formed a primary electrostatic charge latent image. The sheet having the latent image thus formed is fed by rollers 25, 26, 27 and 28 and a guide plate 29 into a developing device 30. In the developing device the latent image is developed with a dry toner developer agent. In this embodiment a magnetic brush of two component developing agent is formed in the device 30. The sheet having the thus formed primary toner image is further transferred by a vacuum suction travelling belt 31 through a flash light fixing device 32 comprising a filter 32A for cutting off visible light. Then the toner image is firmly fixed onto the sheet to form a printing master which is fed out by guide plates 33 and rollers 34 from the apparatus. As explained above the flash light fixing device 32 may be replaced by a solvent gas fixing device. Various types of such a solvent gas fixing device are known from, for example, specifications of Japanese Patent Laid-Open Publications No. 31,629/72 and No. 47,433/76.

Figure 10:
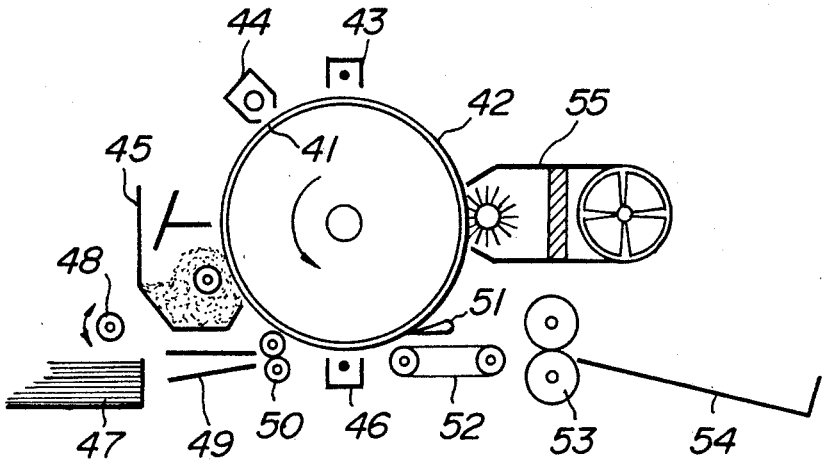
FIG. 10 is a schematic view illustrating an embodiment of an apparatus according to the invention for printing a number of copies with the aid of the master.

FIG. 10 illustrates an embodiment of an electrophotographic printing apparatus which can form a number of duplicated copies from the single master. The apparatus comprises a drum 41 rotatably journaled around which the master sheet 42 is secured. The master sheet 42 may be fixed onto the drum 41 by means of a clamping plate or a set of clamping pins which is known in the off-set printing. The master 41 is first uniformly charged by a corona charger 43 and is then uniformly exposed by a lamp 44 so as to form a secondary latent image. In this case if the amount of the exposure is little, a sufficiently high electrostatic contrast could not be obtained, whereas when the exposure is excessive, the charging potential on the pictorial area might be decreased to cause the decrease in contrast. Therefore a correct amount of exposure should be selected to a suitable value. However if the toner image of the master has an excellent charging property, an excessive exposure is sometimes preferable. The secondary latent image thus formed is developed with toner particles at a toner developing device 45. The development is preferably carried out by means of the two component dry developer agent, but the single component magnetic toner particles having relatively low resistance may be used. Further a suitable bias voltage may be applied and this bias voltage may be adjusted from the external so as to compensate the variation in density of the secondary latent image.

Next the master sheet having the secondary toner image formed thereon is fed to a transfer corona charger 46. An image receiving member such as a plain paper is fed from a paper cassette 47 by means of a pick-up roller 48, guide plates 49 and feeding rollers 50 to the transfer corona charger 46. At this corona charger the paper is made in contact with the master sheet and the secondary toner image is transferred from the master sheet to the paper. The paper is then separated from the master by a craw 51 and is fed to a fixing device comprising heating rollers 53. The final copy having the toner image fixed thereon is supplied onto a tray. Instead of the transfer corona charger 46 use may be made of a biased transfer roller.

Residual toner particles on the master sheet are removed by a cleaner 55. In this manner the master sheet has been prepared for a next copying operation. If there is no residual toners on the master sheet after the transfer step, the cleaning device 55 may be dispensed with.

Figure 11:
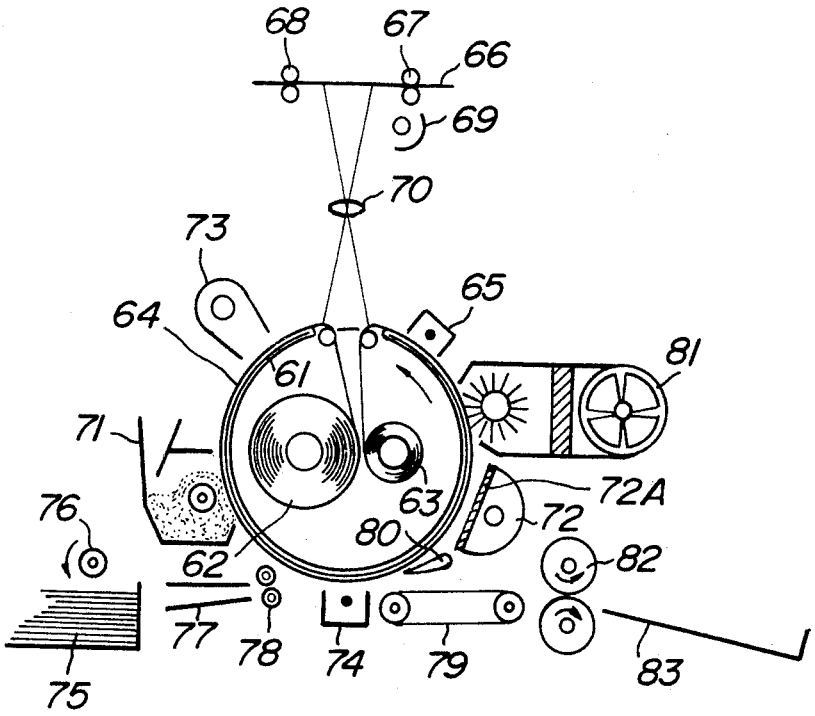
FIG. 11 is a schematic view depicting an embodiment of an apparatus according to the invention for making the master and printing a number of copies with the aid of the master.

FIG. 11 shows schematically a printing apparatus according to the invention in which the master and duplicated copies can be formed in the same apparatus. The apparatus comprises a rotating drum 61 in which are arranged a supply roll 62 and a take up roll 63 of the photosensitive member of web type. As shown in FIG. 11 the photosensitive member is wound around the drum 61. During the formation of the master that part 64 of the photosensitive member which situates on the drum surface is charged by a corona charger 65 to a uniform charging level. A document 66 to be duplicated is fed by feeding rollers 67 and 68 and is irradiated by an illumination device 69. Reflected light from the document 66 is projected by a lens system 70 onto the uniformly charged photosensitive member 64 so as to form a primary electrostatic charge latent image thereon. The primary latent image is developed with dry toner particles by a developing device 71 to form a primary toner image. This toner image is fixed by a flash light fixing device 72 comprising a filter 72A for cutting off visible light to form a master image. If a single image is formed by a substantially whole one revolution of the drum 61, the flash light fixing device 72 has to be actuated several times during one revolution of the drum.

Now the duplicating operation with using the master image thus formed is to be effected. In this case the duplication may be started immediately after the fixing, but if necessary the duplication may be delayed by means of a suitable timer. The delay time may be suitably selected with taking into account the properties of the photosensitive member, toner particles and the fixing procedure. When use is made of the solvent gas fixing instead of the flash light fixing, the delay time may be generally shortened.

The master thus formed is uniformly charged by the corona charger 65 and is then uniformly exposed by an exposing device 73 to form a secondary electrostatic charge latent image. The uniform exposure may be carried out by utilizing the light emitted from the illumination device 69. The secondary latent image thus formed is developed by the developing device 71 to form a secondary toner image. As explained before this toner image is to be transferred onto an image receiving member such as a plain paper and thus the developing may be done by a different developing device from the device 71, in which different toner particles are used. The succeeding processes are same as those explained with reference to FIG. 10 and the secondary toner image is transferred onto the recording paper by means of the transfer corona charger 74. The apparatus comprises a paper cassette 75, a pick-up roller 76, paper guide plates 77, feeding rollers 78, a separating craw 80, a cleaner 81, fixing heat rollers 82 and a tray 83. The function of these elements is identical with that of the corresponding elements illustrated in FIG. 10 and thus a detailed explanation thereof is omitted.

By repeating the above explained steps in succession it is possible to print a desired number of duplicated copies from the single master. Then the take-up roll 63 is actuated to wind the used master and a new part of the photosensitive member is situated around the drum 61.

The apparatus shown in FIG. 11 can utilize several common devices so that it can be constructed in a simple and compact manner. Thus a cost of the apparatus can be lowered and the handling of the user can be improved. The apparatus of FIG. 11 is quite suitable for printing a great number of duplicated copies, but if it is sufficient to form several copies, the apparatus is too expensive for such purpose. In such a case the apparatus may be changed in such a manner that a duplicated copy can be formed by the ordinary Carlson method by effecting the uniform charging, the imagewise exposure, the toner image developing, the toner image transferring onto a paper, the toner image fixing, the cleaning of the photosensitive member, and the discharging the residual charge on the member, or the uniform charging, the imagewise exposure, the toner developing, the toner image transferring onto the paper, and the toner image fixing to form a final duplicated copy and then the succeeding copies are formed by effecting to the residual charge image on the photosensitive member the toner image developing, the toner image transferring and the fixing. In the former case it is preferable to arrange a discharging device such as a lamp and a corona charger between the cleaner 81 and the corona charger 65. In the latter case a biased transfer roller may be used instead of the transfer corona charger and it is necessary to provide a suitable means to make the cleaner inoperable during the printing the copies.

In the process for forming a plurality of copies with aid of the master the rotation speed of the drum can be increased to attain a higher efficiency. A circumferential length of the drum 61 limits the maximum length of the copies. If a copy which is shorter than the peripheral length of the drum is to be formed, only a part of the photosensitive member may be used by changing an area of the member to be illuminated by the flash light and an amount of the taken-up photosensitive member in accordance with a size of the document. By such a measure the photosensitive member can be economically used.

In case of operating the apparatus as a usual electrophotographic apparatus without forming the master it is preferable to count the number of the duplicated copies and when the number of copies has counted to a given value, an order signal for taking-up a given amount of the photosensitive member is produced in a manual or automatic manner. Each time the counter has counted the given value it should be reset to zero so as to produce an information about the fatigue of the photosensitive member. The selection between the printing with and without the master may be effected manually. In the above embodiments the secondary toner image is developed with the dry toner particles, but it may be developed by the known liquid development.

According to the invention a great number of duplicated copies of high image quality can be printed in a relatively simply manner. Further the printing apparatus according to the invention can be constructed in simple and compact and further the operation of the user is very simple and convenient. Moreover the cost of the apparatus can be made lower and a running cost is also inexpensive.

I claim:

1. An electrophotographic duplicating apparatus which can be driven into a multiple copy printing mode with a master for forming a plurality of duplicated copies of an original with the aid of the master which is formed by fixing a toner image corresponding to an image of the original onto a photoconductive sheet, by repeatedly subjecting in succession the master to uniform charging, uniform exposure, development and then transferring and into an electrophotographic printing mode without the master, to thereby form at least one duplicated copy of the original by subjecting a photoconductive sheet to uniform charging, imagewise exposure, development and transferring, comprising:

a drum, said drum is rotatably arranged and is provided with a supply roll and a takeup roll of the photoconductive sheet wound around an outer surface of the drum;

means for rotating the drum, a corona charger arranged along the drum for uniformly charging the photoconductive sheet;

means for projecting the optical image of the original onto the uniformly charged photoconductive sheet to form an electrostatic latent image on the sheet;

a developer arranged along the drum for developing the electrostatic image to form a toner image;

a toner image transferring device arranged along the drum for transferring the toner image onto an image receiving member;

a lamp arranged along the drum for uniformly irradiating the photoconductive member;

a first fixing device arranged along the drum for fixing the toner image on the photoconductive sheet;

a device for successively feeding image receiving members through the transferring device;

a second fixing device for fixing a transferred toner image on the image receiving member; and means responsive to a manual operation for controlling the operation of all of said aforementioned devices whereby in the multiple copy printing mode with, said master, the master is formed by operating the drum rotating means, the corona charger, the image projecting means, the developer device and the first fixing device and then a plurality of copies are formed by repeatedly operating the corona charger, the uniformly irradiating device, the developer device, the transferring device, the image receiving member feeding device and the second fixing device, and in the electrophotographic printing mode without master, the electrostatic image is formed on the photoconductive sheet by operating the drum rotating means, the corona charger and the image projecting means and then at least one copy is formed by operating the developer device, the transferring device, the image receiving member feeding device and the second fixing device.

2. An electrophotographic duplicating apparatus adapted to be driven into a multiple copy printing mode with master for forming a plurality of duplicated copies of an original with the aid of the master which is formed by fixing a toner image corresponding to an image of the original onto a photoconductive sheet repeatedly subjecting in succession the master to uniform charging, uniform exposure, development and transferring, and into an electrophotographic printing mode without master for forming at least one duplicated copy of the original by subjecting the photoconductive sheet to uniform charging, imagewise exposure, development and transferring, comprising:

a drum which is rotatably arranged and is provided with a supply roll and a take-up roll of the photoconductive sheet wound around an outer surface of the drum;

means for rotating the drum;

a corona charger arranged along the drum for uniformly charging the photoconductive sheet;

means for projecting the optical image of the original onto the uniformly charged photoconductive sheet to form an electrostatic latent image on the sheet;

a dry developer device arranged along the drum for developing the electrostatic latent image to form a toner image;

a toner image transferring device arranged along the drum for transferring the toner image onto an image receiving member;

a lamp arranged along the drum for uniformly irradiating the photoconductive member;

a first flash light fixing device arranged along the drum for fixing the toner image on the photoconductive sheet;

a device for successively feeding image receiving members through the transferring device;

a second fixing device for fixing a transferred toner image on the image receiving member;

means for controlling the operation of all of the above-mentioned devices in such a manner that in the multiple copy printing mode with master, the master is formed by operating the drum rotating means, the corona charger, the image projecting means, the dry developer device and the first flash light fixing device and then a plurality of copies are formed by repeatedly operating the corona charger, the uniformly irradiating device, the dry developer device, the transferring device, the image receiving member feeding device and the second fixing device, and in the electrophotographic printing mode without master the electrostatic image is formed on the photoconductive sheet by operating the drum rotating means, the corona charger and the image projecting means and then forming at least one copy by operating the dry developer device, the transferring device, the image receiving member feeding device and the second fixing device; and means responsive to the input number of copies to be printed, with respect to the relevant original for selectively driving said controlling means into the multiple copy printing mode with master and into the electrophotographic printing mode without master.

3. An apparatus according to claim 2, wherein in the multiple copy printing mode with master said supply roll and take-up roll are operated each time a given number of copies has been formed from the same and single master, while in the electrophotographic printing mode wihout master the supply roll and take-up roll are operated each time a predetermined number of copies have been printed, said predetermined number being set in accordance with a fatigue of the photoconductive sheet due to a repetitive use.

4. An apparatus according to claim 3, further comprising a counter for counting the number of duplicated copies during the electrophotographic printing mode without master, means for driving the take-up roll to take-up the photoconductive sheet by a predetermined length when counting value of the counter has reached the predetermined value, and means for resetting the counter to zero when the multiple copy printing mode with master is selected.

* * * * *